United States Patent [19]

White

[11] Patent Number: 4,979,325

[45] Date of Patent: Dec. 25, 1990

[54] DISPLAY FRAME FOR PHOTOGRAPHS AND OTHER SHEET LIKE DOCUMENTS

[76] Inventor: Robert V. White, 195 Curtis Way, Athens, Ga. 30605

[21] Appl. No.: 464,536

[22] Filed: Jan. 16, 1990

[51] Int. Cl.[5] ..... G09F 3/18

[52] U.S. Cl. ..... 40/661; 40/600; 40/649; 40/324; 40/310; 40/152; 215/12.2

[58] Field of Search ..... 40/310, 324, 660, 661, 40/358, 505, 506, 152, 649, 642, 611, 200, 202, 201, 204; 215/12.1, 12.2, DIG. 6; 206/38, 45, 34

[56] References Cited

U.S. PATENT DOCUMENTS

| | | | |
|---|---|---|---|
| D. 96,709 | 8/1935 | Tiedmann . | |
| 1,655,365 | 1/1928 | Gurtov . | |
| 2,000,419 | 5/1935 | Sarber | 40/660 |
| 2,945,314 | 7/1960 | Baldwin | 40/324 |
| 2,984,035 | 5/1961 | Nalle, Jr. | 40/324 |
| 3,306,266 | 2/1967 | McCunney | 40/660 |
| 3,374,911 | 3/1968 | White . | |
| 3,561,146 | 2/1971 | Dembar . | |
| 3,760,521 | 9/1973 | Barraya | 40/152 |
| 4,019,269 | 4/1977 | Vix | 40/19 |
| 4,195,729 | 4/1980 | Macken | 40/152 |
| 4,372,453 | 2/1983 | Branscum | 215/12.2 |

*Primary Examiner*—Kenneth J. Dorner
*Assistant Examiner*—J. Hakomaki
*Attorney, Agent, or Firm*—Thomas & Kerr

[57] ABSTRACT

A display frame [10] for displaying photographs and other sheet-like articles comprises an outer shell [11], a liner [20] and a threaded cap [33]. The outer shell is transparent, generally cup-shaped and has a tapered inner wall [15]. The liner has a tapered outer surface [23] upon which are positioned a series of ribs [26], with the taper of the outer surface of the liner closely matched to that of the inner wall of the outer shell. Photographs or photocopies may be secured to one another and trimmed into an arcuate array [30]and the array placed within the outer shell. As the liner is inserted into the outer shell, the ribs contact the array and act as "skis" to allow the liner to be moved relative to the array without tearing, crumpling or otherwise marking the array.

16 Claims, 2 Drawing Sheets

DISPLAY FRAME FOR PHOTOGRAPHS AND OTHER SHEET LIKE DOCUMENTS

TECHNICAL FIELD

This invention relates to photography and more particularly to display frames for photographs and other sheet like documents.

BACKGROUND OF THE INVENTION

Of the countless photographs taken each year, only a relatively small number are ultimately displayed in frames for viewing. This is due in part to the expense normally associated with framing pictures, the difficulty of placing pictures in frames and the relatively small angle from which traditionally framed pictures may be viewed.

In the past, it has been common to display a single photograph in flat picture frame such as for mounting on a wall or for placing on a desk or table. This traditional flat picture frame is suitable for front viewing, but from the rear presents no viewing access to the photograph. As well, the flat picture frame can be costly and can be inappropriate for displaying a plurality of photographs, such as sequential or panoramic photographs.

U.S. Pat. No. 3,561,146 provides an alternative to the flat display frame, particularly a cube-shaped display frame for displaying pictures on several of the flat faces of the cube. In so doing, each displayed photograph stands apart with little natural flow from one photograph to the other.

In many instances, it is desirable to arrange photographs in a manner to depict the sequential passing of time in the photographs. For example, it may be desirable to frame a series of photographs showing the growth of a baby into a child and from a child into an adult, with the photographs arranged in a manner in which the eye is naturally drawn from one photograph to the next in a logical sequence.

In other situations it may be desirable to display the panoramic sweep of a particular scene as captured in a series of photographs taken at different angles. For example, to capture a scene of 180 degrees, one might use a normal lens to take a first picture, turn the camera slightly and take a second picture, turn the camera slightly yet again to take a subsequent third picture and so on to capture a series of images which collectably would represent 180 degrees of the scene presented to the camera. It is desirable then to display these individual components of the scene in a manner in which a composite panorama results.

Accordingly, it is seen that a need exists for a display frame for photographs and other sheet like documents which is inexpensive, capable of displaying more than one image, capable of being viewed from virtually any angle, and which is particularly well suited to displaying sequential or panoramic images. It is to the provision of such therefore that the present invention is primarily directed.

SUMMARY OF THE INVENTION

In a preferred form, the present invention comprises a display frame for displaying photographs and other sheet-like articles. The display frame includes a hollow, generally cup-shaped, slightly conical, outer transparent member having upper and lower ends and inner and outer walls. The inner wall is frusto-conical and tapers from a first diameter at the upper end to a smaller second diameter at the lower end. The display frame further includes a liner which is insertable into the transparent outer member. The liner includes means for holding the article to be displayed against the inner wall of the transparent outer member. Preferably, the holding means comprises a series of ribs or other raised members formed on its outer surface in a frusto-conical pattern.

So constructed, sheet-like articles such as photographs, photocopies, posters and the like may be placed within the transparent outer member and held close against the inner wall by inserting the liner. As the liner is inserted its ribs contact the sheet-like article to act as "skis" to allow the liner to be moved relative to the article while forcing the article outwardly against the inner wall without tearing, crumpling or otherwise marking the article. At the same time, the ribs allow air to escape from within the display frame between adjacent ribs, the article and the outer surface of the liner, further easing insertion of the liner and firm mounting of the article in the frame.

DETAILED DESCRIPTION

Figure 1:
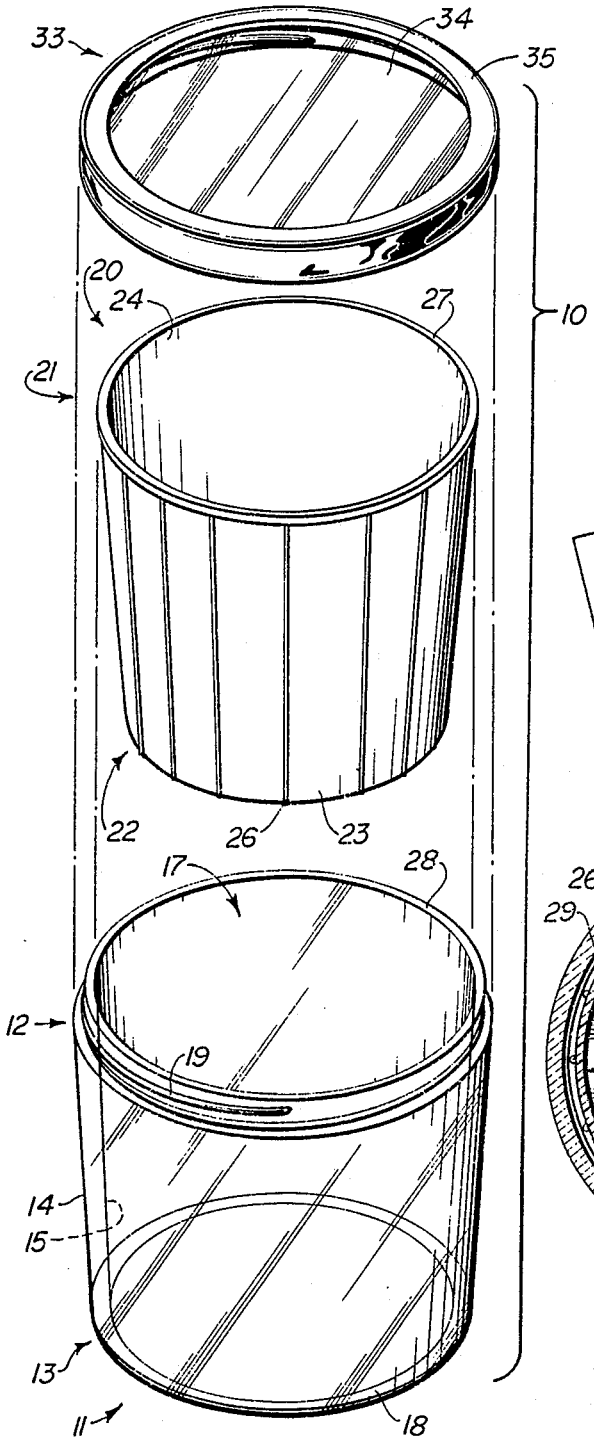
FIG. 1 is an exploded perspective illustration of a display frame embodying principles of the invention in a preferred form.
Figure 3:
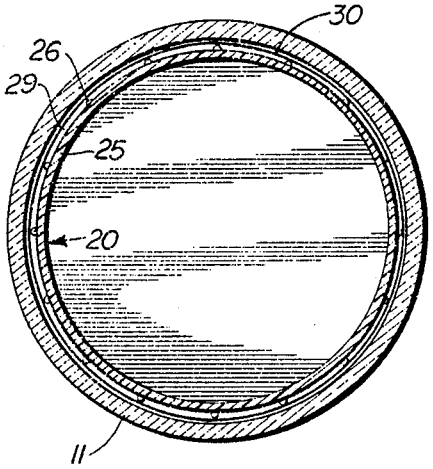
FIG. 3 is a sectional view of the display frame of FIG. 1, with the composite photograph of FIG. 2 shown mounted therein.
Figure 4:
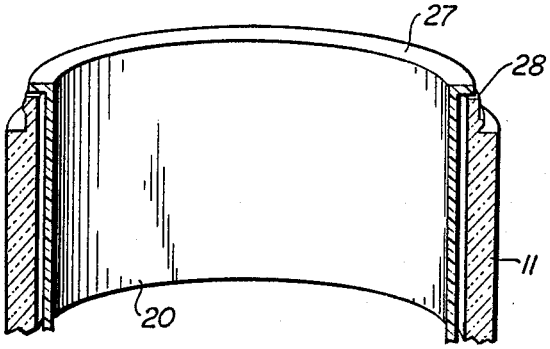
FIG. 4 is a perspective sectional illustration of a portion of the display frame of FIG. 1.

With reference next in more detail to the drawings, in which like numerals represent like parts throughout the several views, FIGS. 1, 3 and 4 show a display frame 10 according to the present invention in a preferred form. The display frame 10 comprises a slightly conical, transparent member or outer shell 11. The outer shell which is of uniform thickness, has an upper end portion 12, a lower end portion 13, a conically tapered outer wall 14 and a conically tapered inner wall 15. The outer shell 11 further has an upper opening and interior space 17 in which articles may be stowed, a bottom wall 18 and an upper threaded portion 19.

The display frame 10 further comprises a liner or holding member 20, which may be of transparent or opaque material. Liner 20 has an upper end portion 21 and a lower end portion 22. The liner has a body portion 25, much of which is of uniform thickness, and has a conically tapered outer surface 23 and a conically tapered inner surface 24. While a hollow liner is shown, a solid liner may be employed as desired.

A series of angularly spaced ribs or raised members 26 are formed on the outer surface 23 and extend generally axially from the upper end portion 21 to the lower end portion 22. The ribs are integrally formed with the body portion, as by injection molding. The liner 20 further has a lip or overhang 27 for creating a substantially airtight and watertight seal when the liner is inserted into the outer shell. As shown in FIG. 4, the lip 27 extends over a portion of an upper bearing surface or rim 28 of outer shell 11. The liner 20 is sized and configured to be inserted into the interior of the outer shell 11, with the tapered outer surface 23 and ribs 26 of the liner 20 having substantially the same angle of taper as the tapered inner wall 15 of the outer shell 11. As shown in FIG. 3, the ribs 26 are evenly arranged around the periphery of the liner 20, with the liner body, the ribs and the outer shell being sized and configured to securely hold a photograph or other sheet-like article 30. The outer surfaces of the ribs distal from the body of the liner form an interrupted frusto-conical surface suitable for holding the articles securely against the shell.

Figure 5:
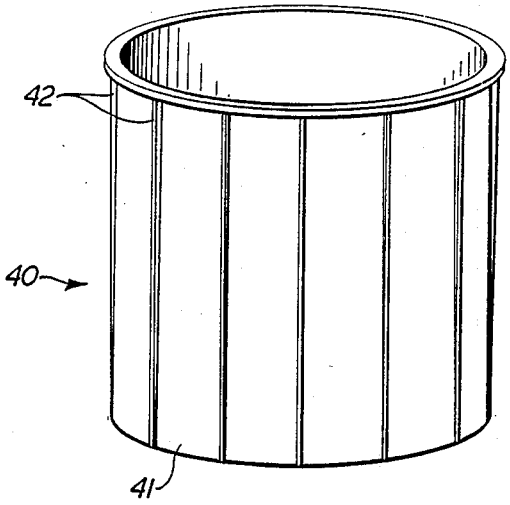
FIG. 5 is a perspective illustration of a portion of a display frame in a second preferred form.
Figure 6:
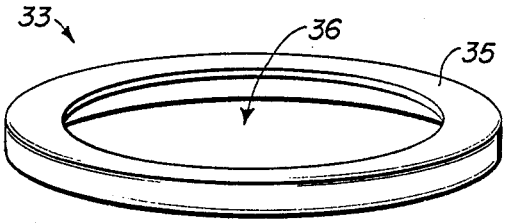
FIG. 6 is a perspective illustration of a portion of a display frame in a third preferred form.

The display frame 10 further comprises a threaded cap member 33 for covering the upper portion of the outer shell 11, as by threading onto threads 19. The threaded cap 33 has a rim portion 35 and a transparent panel 34 below which a photograph may be mounted for viewing. As shown in FIG. 6, alternatively the threaded cap may be formed with a central opening 36, thus making the display frame 10 suitable for holding articles longer than the frame such as pencils, scissors, etc. As shown in FIG. 5 another alternative is provided in which liner 40 is substantially cylindrical and has no significant taper on an outer surface 41. A series of tapered ribs 42 are provided on the outer surface 41, with the taper of the ribs 42 substantially matching the taper of the inner wall 15 of the outer shell 11.

OPERATION

The display frame 10 may be used as follows. The display frame 10 may be disassembled by unscrewing the threaded cap 33 and removing the liner 20 from within the outer shell 11. A photograph or other sheet-like article 30 is then placed within the outer shell 11 with the image to be viewed positioned adjacent the tapered inner wall 15 of the outer shell 11 and facing outwardly. Additionally, a photograph or written information may be placed in the bottom of the outer shell 11. Liner 20 is then reinserted and the threaded cap 33 threaded onto threads 19 of the outer shell 11.

Preferably, the photographic article to be inserted between the liner 20 and the outer shell 11 comprises a photocopy for a variety of reasons. A photocopy is typically produced on thinner paper stock than is commonly employed in the printing of photographs. The thinner paper of a photocopy bends easier and is easier to trim, crop and paste up than are photographs. Photocopies are also more stable over time than color photographs because color photographs have multiple chemical layers atop the photographic paper which break down over time. However, it is recognized that there may be occasions where the qualities of a photograph are desired rather than the qualities of a photocopy.

Figure 2:
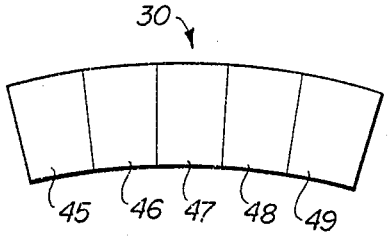
FIG. 2 is a face view of a series of sheet-like articles bearing photographic images attached to each other and arranged in an arcuate array to form a composite photograph.

According to the invention, it is important to use a photocopy or photograph 30 having a arcuate shape similar to that shown in FIG. 2. This is because the tapered inner wall 15 of outer shell 11 and the tapered outer surface 23 of liner 20 each are frusto-conical in shape, thus the need for the arcuate shape.

After the photograph has been inserted flush against wall 15 the liner 20 is inserted past it. As this is done its ribs 26 slide against the back side of the photograph thereby easing insertion and forcing the photograph outwardly against the outer shell 11. In this regard, the ribs act much like skis to ease the installation of the liner 20. As the liner is inserted, air contained within the outer shell 11 escapes through an air space 29 defined by the back surface of the photograph 30, the outer surface 23 of the liner 20 and a pair of adjacent ribs 26. By allowing trapped air to escape, the display frame 10 eases installation of the liner 20 further.

Applicant has found the ribs and tapered surfaces to be advantageous over alternative apparatus or methods. For example, the combination of a tapered liner together with ribs has proven more effective than a liner having a taper but no ribs. Applicant has experimented with a variety of lubricants in connection with a tapered liner having no ribs. However, the lubricants tended to mar the photocopy array 30 and are therefore unacceptable.

An arcuate array of images suitable for insertion into the display frame 10 may be made as follows. Working with a collection of 3 to 6 snapshots or photographs the arranged order is first determined, if any is to be used. The order of images relative to adjacent images may be based on a sequence of events, dates or time, according to the sequence of action or according to a panoramic scene. Next the photos are arranged in a arcuate fashion on an opaque projector and the photographs are projected onto a screen with significant enlargement to aid in the arrangement of the images relative to one another. Any photographs to be enlarged or reduced to create a more uniform, continuous arrangement are then so marked and enlarged or reduced.

The photographs are then duplicated either with a black and white photocopy machine, with a color photocopy machine or other means as desired. The copies are then placed upon a template having the arcuate shape shown in FIG. 2 and then the copies are cut and cropped to correspond roughly to the arcuate shape. The cropped copies are then "pasted up" by taping the overlapping back portions of adjacent copies together so that one continuous photo sheet or array results. Using the template, an outline of the arcuate shape of FIG. 2 is traced onto the back of the single photo sheet and the photosheet is then cut into the arcuate shape. The arcuate array is then ready to be inserted into the transparent outer shell.

The above described invention has the advantages of providing an inexpensive method and apparatus for displaying photographs and other sheet-like documents. The display frame allows 360° viewing and is particularly well suited to displaying panoramic or sequential visual images. As a result of the substantially airtight and watertight seal created when the liner is fuller inserted, the articles displayed with the display frame may be protected form adverse elements for a long time.

While the invention has been disclosed in a preferred form, it will be readily apparent to those skilled in the art that many modifications, additions and deletions may be made thereto within the scope of the invention.

I claim:

1. A display frame for displaying a sheet-like flexible article comprising a generally transparent, hollow shell having a frusto-conically shaped inner wall and means for mounting and holding the article securely against said shell inner wall which comprises an insert having an annular, frusto-conically tapered array of mutually spaced ribs.

2. A display frame as claimed in claim 1 wherein said insert has a frusto-conically shaped body portion from which said ribs radially extend.

3. A display frame as claimed in claim 1 wherein said insert has a generally cylindrical body portion.

4. A display frame as claimed in claim 1 wherein said insert has upper and lower end portions and wherein said array of ribs of said insert extend between said upper and lower end portions of said insert.

5. A display frame as claimed in claim 4 wherein each of said ribs is tapered from a minimum height adjacent said lower end portion to a maximum height adjacent said upper end portion.

6. A display frame as claimed in claim 5 wherein the angle of taper of each of said ribs is substantially the same as the angle of taper of said frusto-conical inner wall of said shell.

7. A display frame as claimed in claim 1 and further including a cap member adapted to cover said hollow shell at an upper end thereof and having means for attaching said cap member to said hollow shell.

8. A display frame as claimed in claim 1 wherein said insert includes an upper lip for sealing the article held between said liner and said hollow shell from atmosphere.

9. A display frame as claimed in claim 4 wherein each of said ribs is substantially uniform in height from adjacent said lower end portion to adjacent said upper end portion and a body portion of said insert is frusto-conically shaped.

10. A display frame for displaying sheet-like articles comprising a generally transparent, hollow shell having inner and outer surfaces, said inner surface being frusto-conically shaped, and a liner insertable into said shell for holding a sheet-like article for display against said shell inner surface and comprising a body portion with a plurality of ribs extending outwardly from said body portion for contacting the sheet-like article as said liner is inserted into said shell.

11. A display frame as claimed in claim 10 wherein said ribs each have an outer surface distal from said body portion, said outer surfaces of said ribs together defining an interrupted frusto-conical surface.

12. A display frame as claimed in claim 11 wherein said body portion of said liner has a generally frusto-conical surface.

13. A display frame as claimed in claim 12 wherein said frusto-conical body portion surface of said liner and said frusto-conical inner surface of said shell have substantially the same angle of taper.

14. A process for mounting for display flat, sheet-like articles and the like, comprising the steps of:

selecting the quantity and arrangement of articles to be displayed;

making a copy of each of the articles;

securing the copies to one another in a side-by-side array;

trimming the array to an arcuate shape;

placing the arcuate array in a transparent, generally cup-shaped outer shell having a tapered inside wall, with the array adjacent the tapered inside wall and facing out; and inserting a liner having a tapered outer portion into the outer shell in a closely nested relationship, with the array adjacent the tapered outer portion, the tapered inside wall of the outer shell and taper outer portion of the liner having substantially the same angle.

15. The process as claimed in claim 14 wherein the liner has a number of spaced ribs on the tapered outer portion for holding the arcuate array adjacent the tapered inside wall of the outer shell, and as the liner is inserted, adjacent ribs together with the array define a channel to allow air within the outer shell to escape, thereby easing insertion.

16. The process as claimed in claim 14 wherein the step of making copies of the articles is accomplished by photocopying.

* * * * *